US005305433A

United States Patent [19]

Ohno

[11] Patent Number: 5,305,433

[45] Date of Patent: Apr. 19, 1994

[54] METHOD AND SYSTEM FOR GENERATING CHARACTERS WITH COMPACT CHARACTER DATA

[75] Inventor: Shoji Ohno, Suwa, Japan

[73] Assignee: Seiko Epson Corporation, Tokyo, Japan

[21] Appl. No.: 590,258

[22] Filed: Sep. 28, 1990

[30] Foreign Application Priority Data

Sep. 29, 1989 [JP] Japan ..... 1-253871
May 25, 1990 [JP] Japan ..... 2-135862

[51] Int. Cl.[5] ..... G06F 15/62

[52] U.S. Cl. ..... 395/150; 395/151; 345/17; 345/128; 345/141; 345/142; 345/143; 345/144

[58] Field of Search ..... 395/150, 151; 340/730, 340/731, 735, 751; 345/17, 128, 141, 142, 143, 144

[56] References Cited

U.S. PATENT DOCUMENTS 4,511,267 4/1985 Pokorney et al. ..... 400/110
4,621,340 11/1986 Pokorney et al. ..... 364/900
4,748,443 5/1988 Uehara et al. ..... 340/751
4,843,593 6/1989 Yanaru et al. ..... 364/900
4,897,638 1/1990 Kokunishi et al. ..... 340/751
5,018,217 5/1991 Yoshida et al. ..... 382/22
5,113,491 5/1992 Yamazaki ..... 395/141

FOREIGN PATENT DOCUMENTS 129447 12/1974 Japan .
14230 2/1975 Japan .

*Primary Examiner*—Gary V. Harkcom
*Assistant Examiner*—Joseph H. Feild
*Attorney, Agent, or Firm*—Harold T. Tsiang

[57] ABSTRACT

A character generator and method which requires reduced storage memory space for a character memory by virtue of generating bit fill patterns that fill character borders. The borders are, in turn, generated from partial borders that are local to the starting, ending, and any middle coordinate points of an imaginary baseline roughly drawn along the centerlines of strokes making up the character. As especially applied to Japanese and Chinese character sets, the character generator and method further improve on memory storage savings by separating basic characters from compound characters. The compound characters are then generated in terms of reshaped and repositioned basic characters, thus eliminating the redundancies that would otherwise exist.

30 Claims, 11 Drawing Sheets

日

Fig. 1(a)

月

Fig. 1(b)

明

Fig. 1(c)

山

Fig. 1(d)

上

Fig. 1(e)

下

Fig. 1(f)

峠

Fig. 1(g)

代

Fig. 1(h)

貝

Fig. 1(i)

貸

Fig. 1(j)

目

Fig. 1(k)

ハ

Fig. 1(l)

METHOD AND SYSTEM FOR GENERATING CHARACTERS WITH COMPACT CHARACTER DATA

BACKGROUND OF THE INVENTION

This invention relates generally to the printing and displaying of text fonts, and more particularly to data compression techniques which are especially applied to printing and storing of the Japanese, Chinese, and Korean language character sets, each of which has several thousand unique characters that must be available in a computer system to allow the eloquent expression of the respective language.

Japanese, Chinese, and Korean writing differ from the written forms of Indo-European languages in that each character usually represents a whole word and sometimes even a phrase. Because of this, the written language is not as inextricably tied to the spoken language as it is where the alphabet is used. For example, even though the Peoples' Republic of China (PRC) has a population that speaks hundreds of different dialects of Chinese (that really are different languages), the Chinese all write in a common text that is universally and perfectly understandable throughout the PRC. (And just as Emperor Han of China had intended when he commanded 2,000 years ago that all of China must use the same writing so that his far-flung bureaucracy could function.) In contrast, the English language alphabet of 26 letters is used to assemble words ranging from a single letter to words comprising dozens of letters. The spellings in English are (more or less) directly related to how spoken English is enunciated. Each of the written European languages is inextricably bonded with the corresponding spoken languages. Because the Far Eastern language writing characters were coined two thousand years ago, certain more modern concepts and objects lacked a corresponding written character. Combinations of the earlier characters came to be employed to represent the new word or phrase. For example, the equivalent of the word "bright" had not existed in the original Japanese Kanji (which is a descendant of the Chinese Hansi). There was, however, a character for "sun" (FIG. 1(*a*)) and a character for "moon" (FIG. 1(*b*)). Together, the light from the sun and the moon together would be bright. Therefore the character for bright (FIG. 1(*c*)) is the concatenation of the earlier two characters. Similarly, the character for "mountain pass" is the concatenation of three characters representing: "mountain" (FIG. 1(*d*)), "up" (FIG. 1(*e*)), and "down" (FIG. 1(*f*)). The original thinking may have been that you must go up a mountain to go down through a notch at the summit that is the mountain pass. The character for mountain pass results (FIG. 1(*g*)). And as a final example, the character representing "lend" is made up from the characters for "substitute" (FIG. 1(*h*)) and "shell" (FIG. 1(*i*)). Since shells were used thousands of years ago as money, the modern combination is really "substitute money," which is the real effect of lending. The character for "lend" therefore has two parts (FIG. 1(*j*)).

It has been determined by the present inventor that the storage of a near complete Japanese Kanji character set (approximately 7,000 characters) in a computer memory will usually require 512K bytes. But to store just the basic one element sub-set of that with the multi-element characters entered as being combinations of the single element characters, requires only a quarter as much, i.e., 128K bytes. Such a method of reducing the storage requirements is a type of data compression and is an advantage of the present invention.

Another characteristic of the written Far Eastern languages is that the perfect written expression of each character will include brush stroke artifacts. These include the fat beginning of a brush stroke and the thin tail at the end of the same stroke. These artifacts are impossible to represent with a single line of uniform width. They can, however, be represented by bitmap and outline font methods. Bitmap and outline font methods are conventional, e.g., the Apple Computer Macintosh II uses both for display and printing. Such artifacts and details in written English language characters can make one font recognizable over another. For example, the capital "I" in a popular laserprint font called "Times" has serifs, but the capital "I" in another popular laserprinter font called "Helvetica" does not. Being able to see details as fine as a serif in Kanji or in Hansi is more important, very fine differences can be the only way a reader will be able to discern between two otherwise very similar characters having two totally distinct meanings.

In the bitmap method, each character is represented by a matrix of dots, some black and some white. The fewer the number of total dots used in the matrix, the more ragged the final characters will appear. High quality therefore requires using bitmap matrices having at least 16 dots per side. The number of bits required to store the bitmap goes up as the square of the number of dots that are on a side. Bitmaps have the advantage of being easily communicated to a printer by a computer, but have the concomitant disadvantage of consuming large amounts of memory. Bitmaps have the further disadvantage of not being readily scaled up or down in size. In the Apple Macintosh, each bitmapped font has a whole set stored for each of the common point sizes (e.g., 8, 10, 12, 14, 18, 20, and 24). Odd sizes, or larger sizes, are interpolated or extrapolated—with rather poor results. If the whole Japanese Kanji character set was to be stored in bitmap form, the amount of memory consumed would be intolerable. Keeping more than one size would only exacerbate the problem. The temptation in the prior art is then to store less than the full set.

The outline font method scales up and down easily and produces high quality smooth edges at all sizes. Coordinates for the position and formulas for the scaling and borders of characters are maintained in the outline font method. Only one set is necessary for each character, since high quality characters can be scaled up or down and placed in any desired position. The outline font method is particularly suitable for Kanji and Hansi characters, and is used in the embodiment of the present invention described below. Codes are used to fetch boundary data from font storage and the outlines formed from the boundaries are filled by bits. The resulting bit fill is then set to a printer for output. A Japanese Patent Application, laid open in JPO Official Gazette No. 50-14230, discloses a system in which the character pattern is stored in accordance with coordinate data, a scaling of character sizes and of the forms of character is thereafter easily accomplished. The outline font method has an advantage of reduced memory needs, but not as much of a reduction as might be expected, because now border data must be kept for all the characters.

A Japanese Patent Application, laid open in JPO Official Gazette No. 49-129447, discloses a system in which the individual stroke components of a character are resolved into top, bottom, right, and left side boundary data and stroke data. A Kanji character is then reconstructed by assembling standardized stroke data using constituent strokes of a character. The system has the advantage of needing less memory for storage. However, since the pattern for each component has been standardized, the quality of the reconstructed characters is poor.

The prior art has failed to provide a solution that simultaneously provides high quality and modest memory storage space requirements. Outline data for the relatively straight portions of a character conveys very little in the way of useful artifact details, and yet requires just as much memory as more useful portions. The starts, ends, and bends of a character's constituent strokes are rich with artifact details. The present invention retains the details of the starts, ends, and bends of a character's constituent strokes using border data, and steps back to using imaginary baselines to describe the backbone of a character's component strokes.

SUMMARY OF THE INVENTION

An object of the present invention is to provide a character pattern data generator that is capable of producing characters having variable line widths in various parts together with reduced system memory storage requirements.

Another object of the present invention is to provide a character pattern data structure capable of supporting complex character pattern generation.

A further object of the present invention is to provide a character pattern data structure that is capable of striking a balance between storing machine assembled standardized characters and stylized characters.

Briefly, the present invention comprises generating starting and ending point coordinates for a base line which passes through the center between borders of a character, and generating intermediate point coordinate data that is coincident with any bending point(s) of the base line and which lie between the starting and ending point coordinates. And further comprising a character memory for storing local border data representing a local formation around of each of the above coordinates, a generator that fetches from character memory in response to code and completes the drawing of a whole character's border data starting with only the coordinate data and local border data, and means for generating bit data to fill a region described by the character's border data.

An advantage of the present invention is that character patterns can be generated using a smaller amount of data than required by prior art methods which store data for the whole border of each character.

A further advantage of the present invention is larger and smaller characters of all sizes can be readily produced with no loss of resolution or printing quality.

A further advantage of the present invention is that the data storage of characters for all alphabets and languages is improved over prior art outline font methods.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

FIGS. 1(*a*)–(*j*) are various prior art Kanji characters belonging to the written Japanese language;

FIG. 16A details the baseline, coordinates, and local border data; FIG. 16B shows the completed outline of the character after contouring.

DESCRIPTION OF THE PREFERRED EMBODIMENTS

Figure 2:
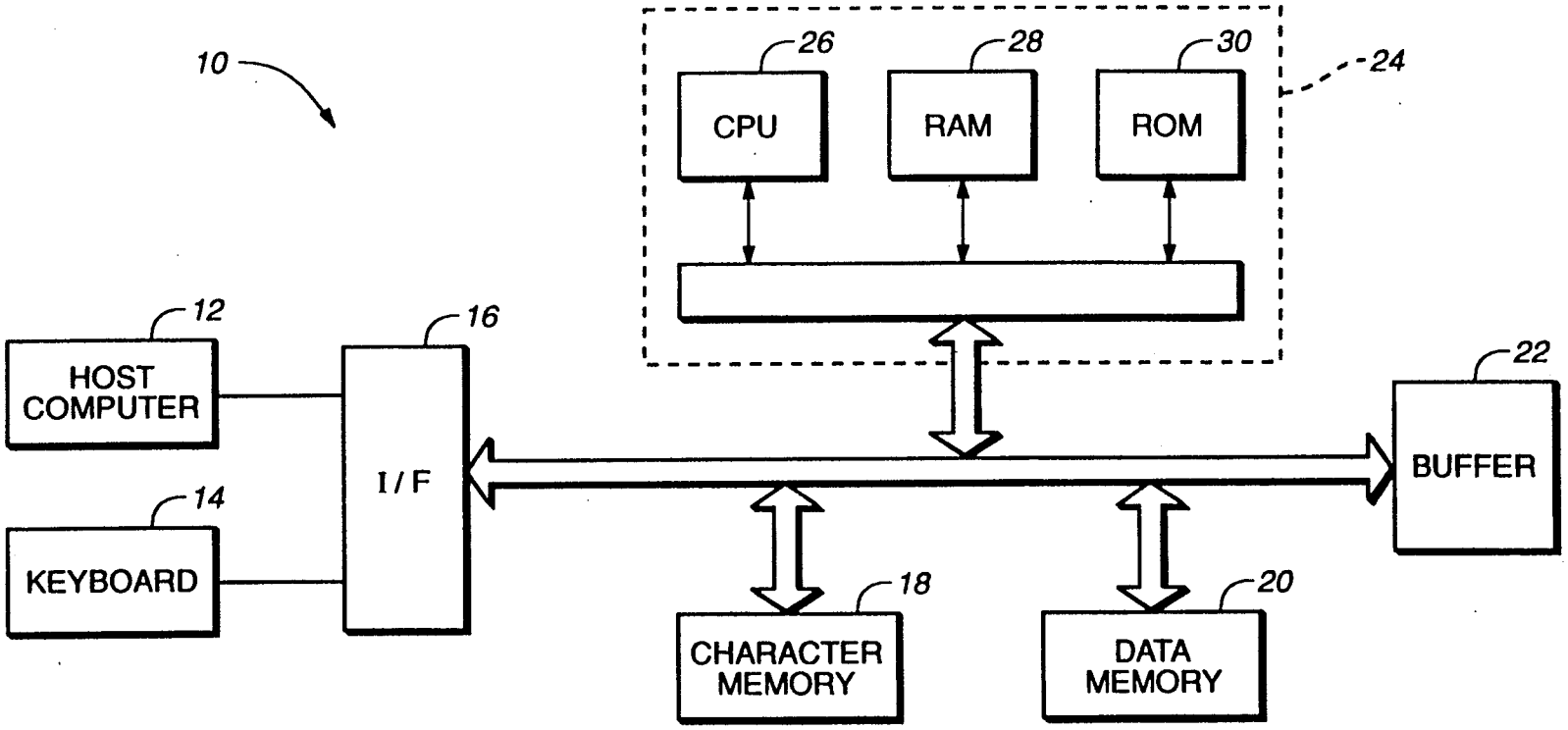
FIG. 2 is a block diagram a character generating system constructed in accordance with the present invention.

FIG. 2 is a character pattern generating system incorporating the present invention, and is referred to by the general reference numeral 10. System 10 comprises a host computer 12, a keyboard 14, an interface 16, a character memory 18, a system memory 20, an output buffer 22, and a microcontroller 24. Microcontroller 24 is in turn comprised of a CPU 26, a RAM 28 and a ROM 30. Computer-implemented processes are permanently stored in ROM 30 and as such will be referred to by those skilled in the art as "firmware." On the basis of character code and attribute data being input from an external device, such as keyboard 14 and the host computer 12, via interface 16, a data structure (described below) in the character memory 18 is read out. A bit pattern is produced from the data indexed by the character code and the bit pattern is deposited in data memory 20. Memory 20 is preferably RAM which can be both read and written. The bit pattern data is then output to a display and/or a printer through output buffer 22.

Figure 3:
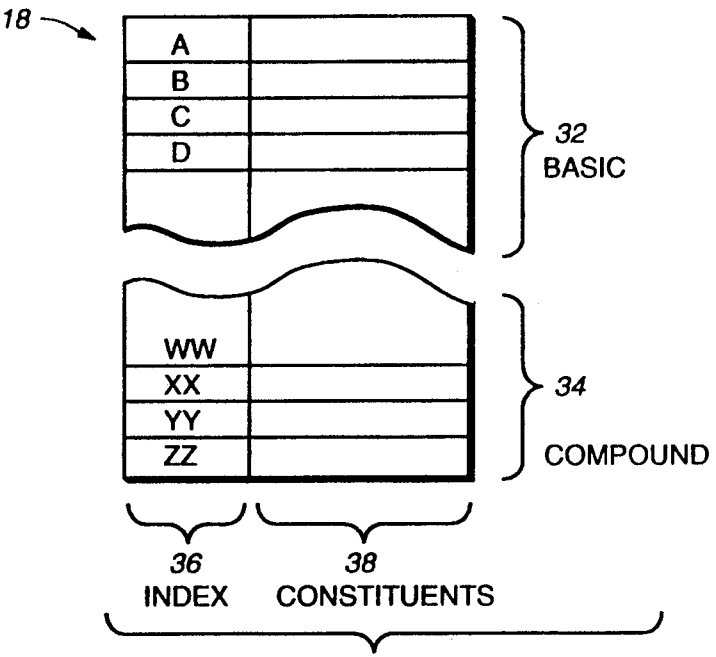
FIG. 3 is a diagram of the top level data structure used to store character data in the data memory of the system in FIG. 2. It is divided into basic and compound character storage areas.
Figure 4:
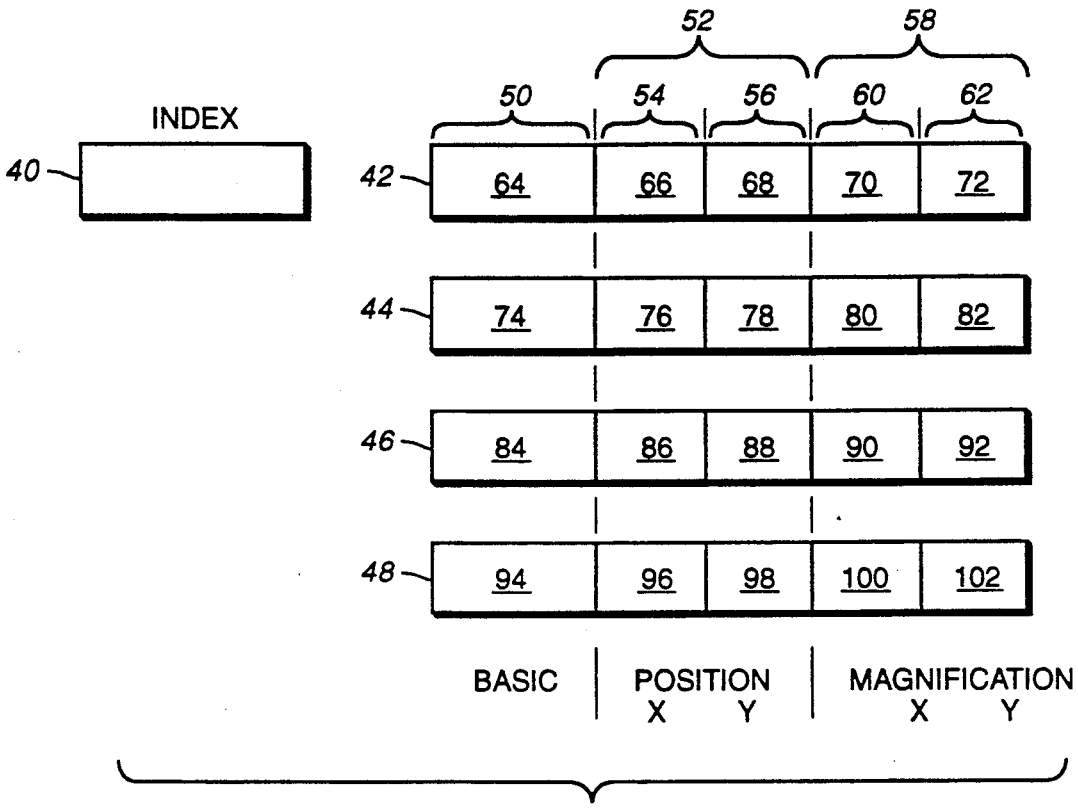
FIG. 4 is a diagram of the data structure of the compound character storage diagrammed in FIG. 3.

FIG. 3 represents character memory 18. It is divided into a first region 32 for storing basic character codes and a second region 34 for storing compound character codes. As an example, the basic Kanji characters of FIGS. 1(*d*), (*e*), and (*f*) will be stored in the first region 32. These will be directly available and accessed when a basic character is needed for a job. An exemplary compound character is FIG. 1(*g*). This compound character is comprised of three basic Kanji characters, such as in FIGS. 1(*d*), (*e*), and (*f*). Compound characters are stored in the second region 34. A job requiring, for example, the compound character of FIG. 1(*g*) will cause an indirect reference of the basic characters of FIGS. 1(*d*), (*e*), and (*f*). Regions 32 and 34 each have a plurality of index fields 36 and a plurality of constituent fields 38. The index fields 36 contains character codes, e.g. "A" to "ZZ" in FIG. 3. Every code is associated with a plurality of coordinate, position, and magnification data in the constituent fields 38. FIG. 4 provides more details of fields 36 and 38.

FIG. 4 is one entry in the (compound) second region 34 of character memory 18. For example, this entry has a code for the character of FIG. 1(*g*) in an index 40. A plurality of rows 42, 44, 46, and 48 have a basic character pointer field 50, a position field 52 comprised of an X-position sub-field 54 and a Y-position sub-field 56, and a magnification field 58 comprised of an X-magnification sub-field 60 and a Y-magnification sub-field 62. A pointer 64 is used to index into region 32 to fetch border data to draw the basic character of FIG. 1(*d*). Row 42 has a X-position data 66 and a Y-position data 68 together with an X-magnification data 70 and a Y-magnification 72. These data are used to tuck a compressed version of the basic character of FIG. 1(*d*) into the left-hand side of the space allotted for it within the character represented by FIG. 1(*g*). A pointer 74 is used to index into region 32 to fetch border data for the basic character of FIG. 1(*e*). Row 44 has a X-position data 76 and a Y-position data 78 together with an X-magnification data 80 and a Y-magnification 82. These data are used to tuck a compressed version of the basic character of FIG. 1(*e*) into the upper right-hand side of the space allotted for it within the character represented by FIG. 1(*g*). A pointer 84 is used to index into region 32 to fetch border data for the third and final basic character of FIG. 1(*f*). Row 46 has a X-position data 86 and a Y-position data 88 together with an X-magnification data 90 and a Y-magnification 92. These data are used to tuck a compressed version of the basic character of FIG. 1(*f*) into the lower right-hand side of the space allotted for it within the character represented by FIG. 1(*g*). Row 48 is empty, because only three basic characters comprise the compound character represented by FIG. 1(*g*).

Figure 5:
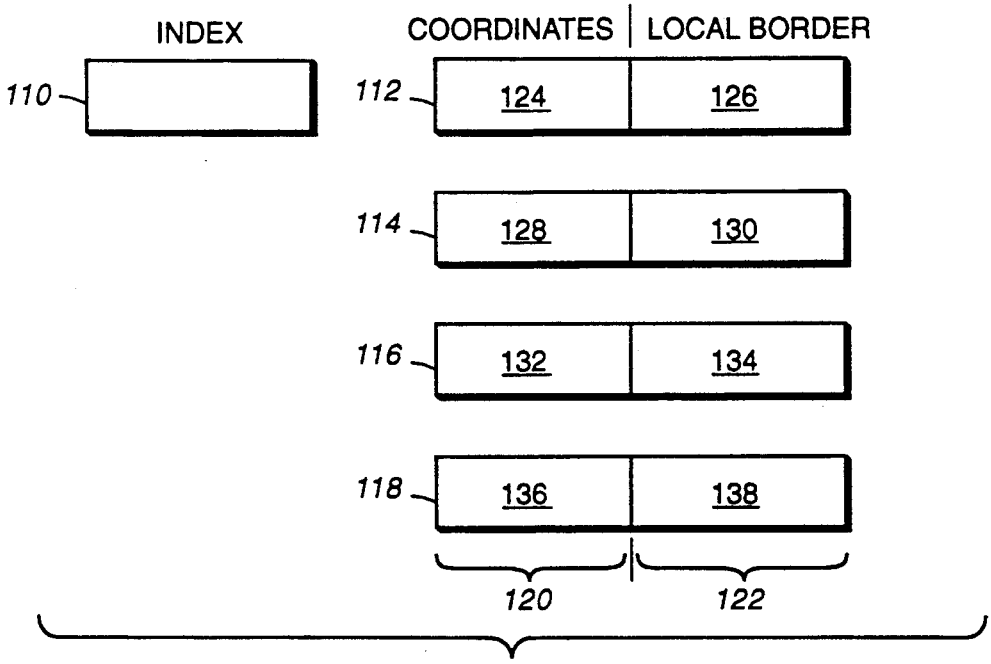
FIG. 5 is a diagram of the data structure of the basic character storage diagrammed in FIG. 3.

FIG. 5 is one entry in the (basic) first region 32 of character memory 18. For example, this entry has a code for the character of FIG. 1(*d*) in an index 110. The character is composed of four strokes (three vertical, and one horizontal). Data for the first stroke is stored in a row 112. Data for the second stroke is stored in a row 114. Data for the third stroke is stored in a row 116. And finally, data for the fourth stroke is stored in a row 118. More than four rows is possible, but more are not necessary to completely describe the character in the present example. Each of rows 112, 114, 116, and 118 have a coordinates field 120 and a local border data field 122. Coordinates data 124 comprises coordinates for the start, middle, and ending points of an imaginary baseline (described below) that runs through the centerline between the longitudinal borders of the first stroke of the character in FIG. 1(*d*). The middle coordinate points are placed at any bends of the imaginary baseline. (The imaginary baseline can have several bends or none at all.) Local border data 126 comprises a plurality of X-Y coordinates relative to a coordinate data 124 that, in a connect-the-dots fashion, will approximate with straight-line segments the features of the borders at the start, middle bend, and end of a stroke. Coordinates data 128 comprises coordinates for the start, middle, and ending points of an imaginary baseline (described below) that runs through the centerline between the longitudinal borders of the second stroke of the character in FIG. 1(*d*). The middle points are placed at any bends of the imaginary baseline which can have several bends or none at all. Local border data 130 comprises a plurality of X-Y coordinates relative to a coordinate in data 128 that, again in a connect-the-dots fashion, will approximate with straight-line segments the features of the borders at the start, middle bend, and end of the second stroke. The above is repeated for the remaining strokes.

Figure 6:
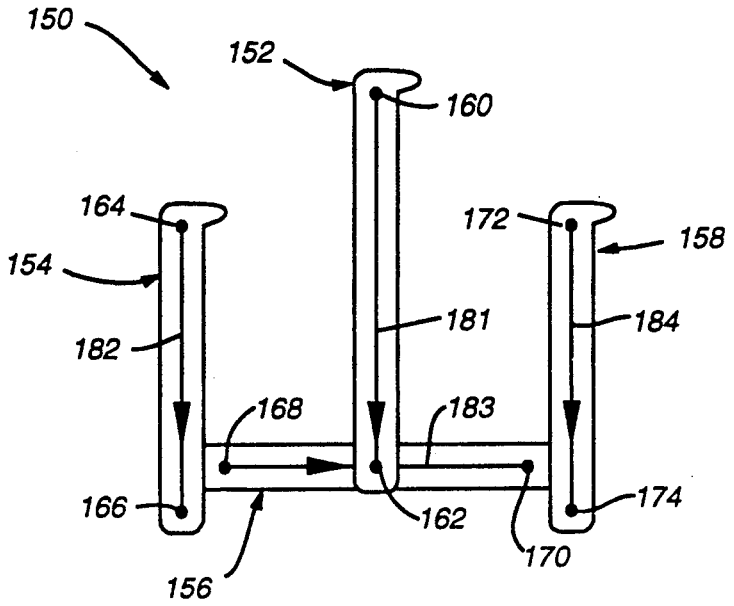
FIG. 6 is a diagram of a basic Kanji character showing imaginary baselines and coordinates associated with the four constituent strokes that comprise the character.

FIG. 6 is a close-up of the character of FIG. 1(*d*), and is referred to by the general reference numeral 150. Character 150 is comprised of a first stroke 152, a second stroke 154, a third stroke 156, and a fourth stroke 158. (This order of brush strokes is what a writer trained in Kanji script will follow.) Stroke 152 begins at point 160 having starting coordinates $X_{s1}$, $Y_{s1}$, and ends at point 162 having ending coordinates $X_{e1}$, $Y_{e1}$. Stroke 154 begins at a point 164 having starting coordinates $X_{s2}$, $Y_{s2}$, and ends at a point 166 having ending coordinates $X_{e2}$, $Y_{e2}$. Stroke 156 begins at a point 168 having starting coordinates $X_{s3}$, $Y_{s3}$, and ends at a point 170 having ending coordinates $X_{e3}$, $Y_{e3}$. Stroke 158 begins at a point 172 having starting coordinates $X_{s4}$, $Y_{s4}$, and ends at a point 174 having ending coordinates $X_{e4}$, $Y_{e4}$. Because the above four strokes 152, 154, 156, and 160 are essentially straight lines, there are no bends and therefore no middle coordinates $X_m$, $Y_m$. (See below for middle coordinate discussion with regard to FIG. 15.)

Figure 7:
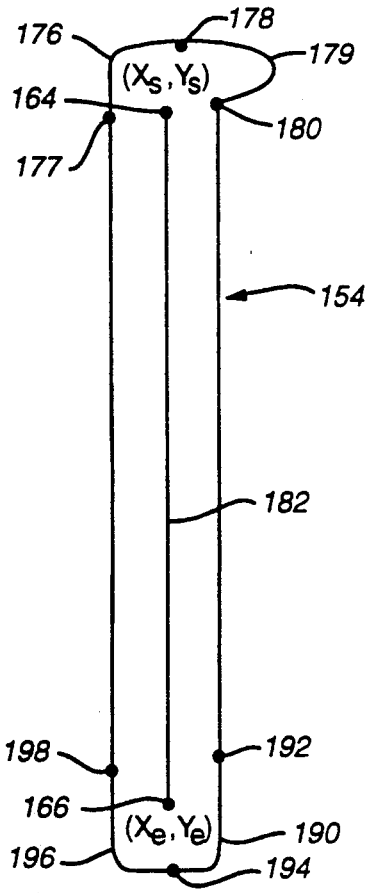
FIG. 7 is a diagram of the second stroke of the Kanji character of FIG. 6. Details of the relationship between the starting and ending coordinates together with their respective local borders are shown.

FIG. 7 is a close-up of stroke 154. Starting point 164 is surrounded by a first local border segment 176 between a point 177 and a point 178, and a second local border segment 179 between point 178 and a point 180. Referring back for a moment to FIG. 6, an imaginary baseline 181 joins points 160 and 162, an imaginary baseline 182 joins points 164 and 166, an imaginary baseline 183 joins points 168 and 170, and an imaginary baseline 184 joins points 172 and 174. Ending point 166 has a first local border segment 190 between a point 192 and a point 194, and a second local border segment 196 between point 194 and a point 198. The border data related to stroke 154 is used to form a whole outline by connecting point 177 to point 198, and point 180 to point 192, with straight lines. The four local border segments 176, 179, 190, and 196 are actually piece-wise straight line approximations of the curves they resemble.

Figure 8:
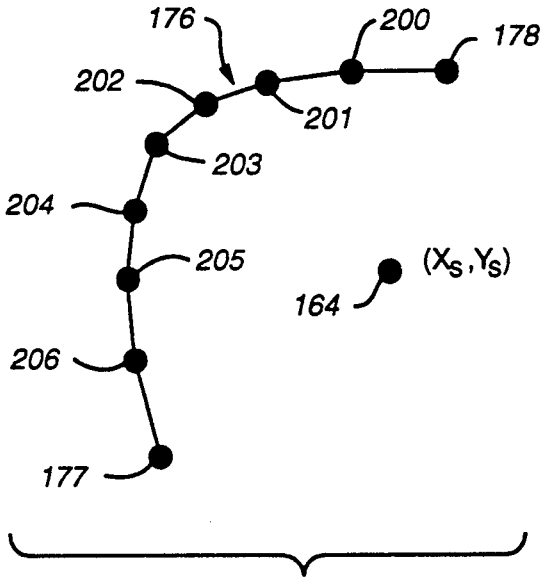
FIG. 8 is a diagram of one of the local borders of FIG. 7 showing the details of several coordinates which approximate a curved line when interconnected with straight line segments.

FIG. 8 is a close-up of local border segment 176. A plurality of points 200–206 have straight line segments between each of them. Therefore the data storage of local boundary segment 176 actually consists of the X-Y coordinates of points 177, 178, and 200–206, which are all expressed relative to starting point 164. An alternative embodiment adds an additional byte of data to indicate the angular quadrant segment 180 occupies relative to point 164. (See discussion of FIG. 14 below.) At the level of detail shown by FIG. 8, it should be obvious that the complete outline of the whole of character 150 consists of nothing more than a small list of coordinates which are associated with a character code representing character 150. These points are joined in the above mentioned connect-the-dots method to form a closed boundary. A computer-implemented process running on microcontroller 24 then fills the inside of the completed boundary with dots and builds a bitmap image in data memory 20. The overall effect of the above is to reduce the number of dots and therefore bits necessary to draw a set of high quality characters.

Microcontroller 24 is able to change the position and shape of characters by manipulating the coordinate data and local border data (which is also coordinate data). Fields 52 and 58 each have X and Y sub-parts. Position data, in X, Y form, determine the point at which to place the top-left corner of a character. Magnification data, in X, Y form, determines the degree to which a character is to be magnified (or reduced) in the X direction and/or the Y direction.

Figure 9:
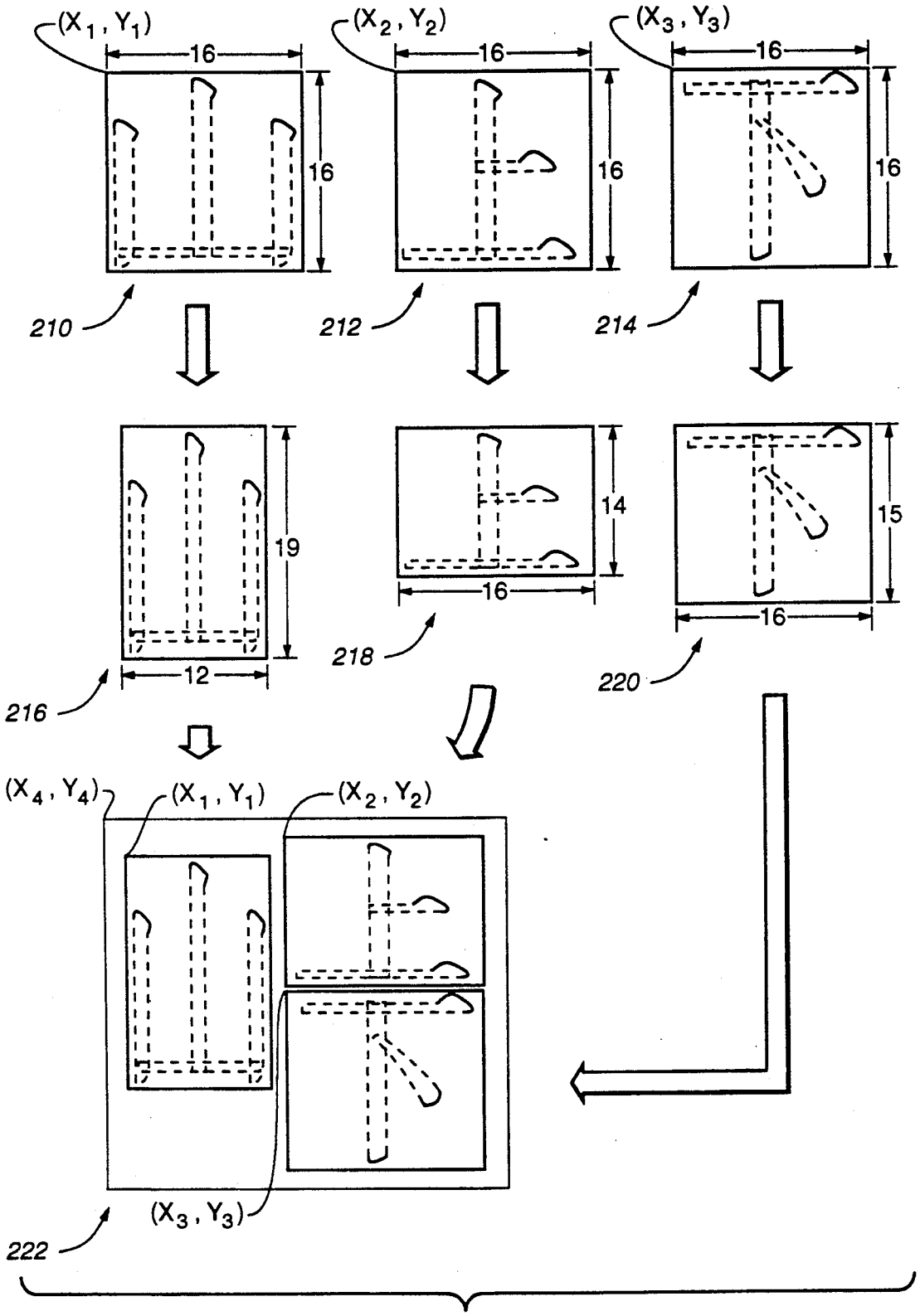
FIG. 9 is a diagram showing how three basic characters from the basic character storage area are reshaped and positioned to form a compound character. The compound character is stored in the compound character storage area and contains pointers to the three basic characters and reshaping and positioning data for each.

Referring now to FIG. 9, exemplary basic characters 210, 212, and 214 (the same character as in FIGS. 1(*d*), (*e*), and (*f*)) have standard dimensions 16 dots tall and 16 dots wide (i.e., a 16×16 matrix). A taller and narrower character 216 is formed by reducing character 210 horizontally to 12 dots and enlarging it vertically to 19 dots. A shorter and wider character 218 is formed by enlarging character 212 horizontally to 16 dots and reducing it vertically to 14 dots. A shorter and wider character 220 is formed by enlarging character 214 horizontally to 16 dots and reducing it vertically to 15 dots. A compound character 222 is comprised of characters 216, 218, and 220, rather than characters 210, 212, and 214, because Kanji writing convention dictates that the three constituent basic characters be compressed and arranged in a distinctive way to differentiate them from being just three separate characters that are very close to one another. This is not unlike the importance of spaces in the English compression of "an" and "other" into "another", which are three words having totally independent meanings. In the example of character 210 being transformed into character 216, the X-magnification is therefore 12/16 and the Y-magnification is 19/16. Referring back to FIG. 4 for a moment, magnification information such as this will be stored in field 58. The starting point coordinates of each constituent stroke are $X_s$, $Y_s$, the intermediate point coordinates are $X_m$, $Y_m$ and the ending point coordinates are $X_e$, $Y_e$. These coordinates are all expressed relative to a local reference point, e.g. $X_1$, $Y_1$, $X_2$, $Y_2$, and $X_3$, $Y_3$, respectively, for characters 210, 212, and 214 in FIG. 9. The above coordinates describe the start, middle, and end of an imaginary base line existing within each of the strokes of the basic characters. During reshaping, all the coordinates for character 210 are multiplied by 12/16 in the X direction and by 19/16 in the Y direction. This results in new coordinates comprising character 216. Assuming basic character 210 has a stroke with a starting point coordinate $X_s$, $Y_s$ that is 2,4, that coordinate will be moved to a new coordinate $X_s'$, $Y_s'$ of 1.5,4.75 in character 216. The movement value becomes −0.5 in the direction and +0.75 in the Y direction. Similarly, the intermediate point coordinate $X_m$, $Y_m$ is moved to a new intermediate coordinate $X_m'$, $Y_m'$ and the ending point coordinate $X_e$, $Y_e$ is moved to the new ending point coordinate $X_e'$, $Y_e'$. Local border data, because it is relative to the starting, ending, and middle coordinates, naturally moves along to the proper places in the transformed character. Good results can be obtained by not scaling local border data. However, scaling should be included when the demands of readability exceed the costs in computing time to perform the scaling operations. Position data, e.g., field 52 in FIG. 4, is used to reposition basic characters within a compound character's space. For example, characters 210, 212, and 214 each have reference points $X_1$, $Y_1$, $X_2$, $Y_2$, and $X_3$, $Y_3$, respectively, that find new positions in character 222 relative to $X_4$, $Y_4$. It is possible for the compound character 222 to become a component character of a still more complex character by scaling and positioning character 222 using its $X_4$, $Y_4$ reference to position it as characters 210, etc., had been relatively placed in character 222.

Figure 10:
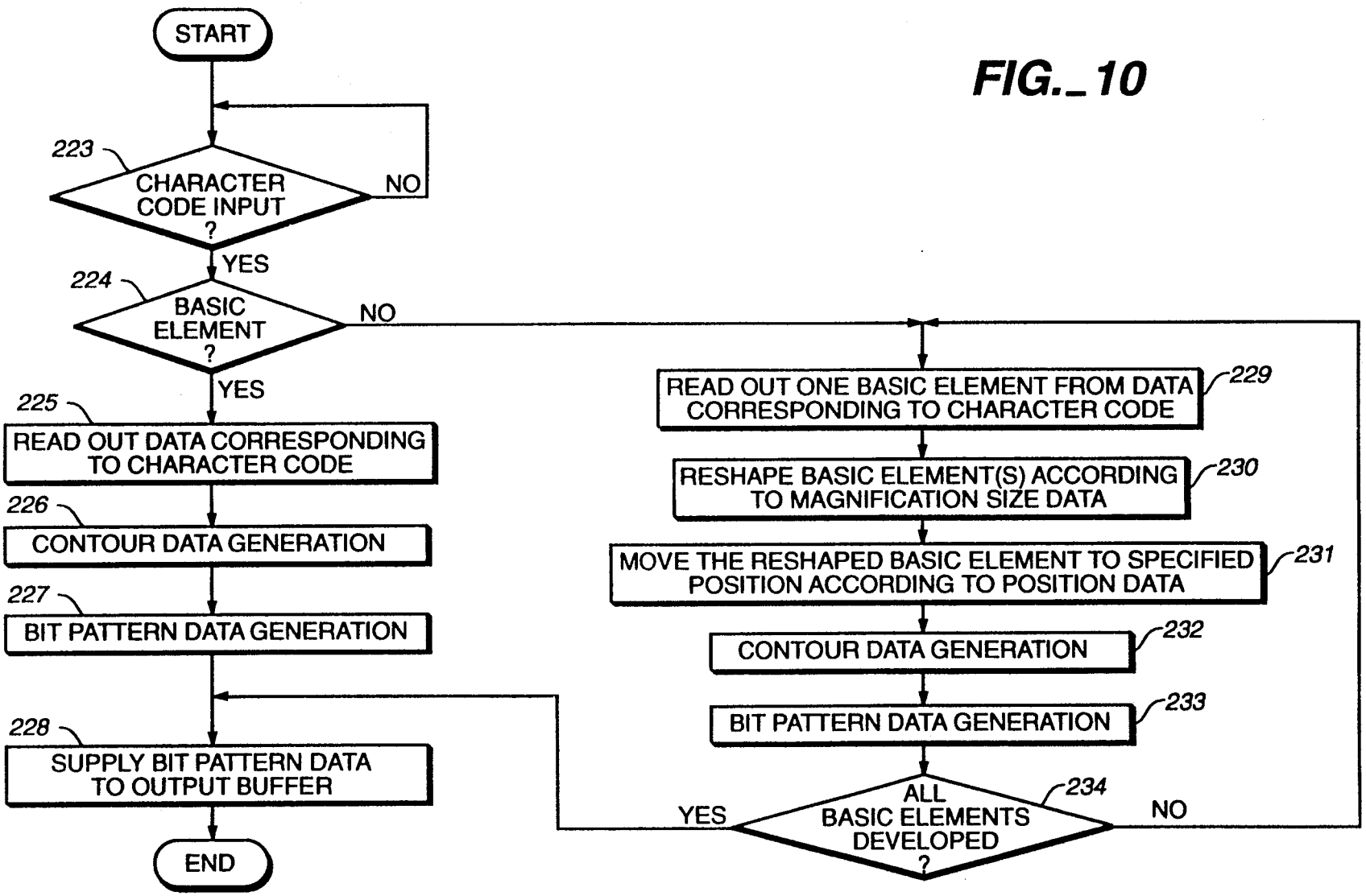
FIG. 10 is a flowchart of a first computer-implemented process that runs on the system of FIG. 2.

FIG. 10 is a flowchart for an exemplary computer-implemented process that runs on microcontroller 24. The process is comprised of steps 223–234. The process loops at step 223 waiting for a character code to be input. When a character code is input, e.g., from an external device such as keyboard 14 or host-computer 12, microcontroller 24 determines at step 224 whether the character code is a basic character code or a compound character code. If it is a basic character code, microcontroller 24 accesses, at step 225, character memory 18 and reads out a starting point coordinate ($X_s$, $Y_s$), an ending point coordinate ($X_e$, $Y_e$), any intermediate point coordinates ($X_m$, $Y_m$), and the associated local border data. (As explained above, coordinate data are used to give relative positions for the local border data.) At step 226 the several local borders are placed and lines drawn to connect between them, thus forming a complete outline of the intended final character. The assembly of the basic character is made within data memory 20. Referring to FIG. 7 as an example, local border data consists of lines 176, 179, 190, and 196. These lines are positioned relative to point 164 (for lines 176 and 179) and point 166 (for lines 190 and 196). In FIG. 10, step 226 will connect lines 176 and 179 at point 178 and connect lines 190 and 196 at point 194. Step 226 will also draw line segments between points 177 and 198 and between points 180 and 192, thus completing the outline of the brush stroke 154. This final drawing of lines is responsible for a significant portion of the advantage of the present invention. The outline is then filled with a bit pattern at step 227 and output to a printer through output buffer 22 at step 228. When step 224 determines that the input character code is not a basic character code, but rather a compound character code, e.g., the character of FIG. 1(*g*), the process branches to step 229. Microcontroller 24 accesses the (compound) second region 34 of character memory 18 to read out constituent field 38. A first basic character to be used in the assembly of the compound character is fetched, e.g., from row 42. The basic character is accessed as described above for step 225. The basic character is then shaped in step 230 and positioned in step 231, according to the position and magnification data found, e.g., in fields 52 and 58. An incremental assembly of compound characters is made within data memory 20. Step 232 is equivalent to step 226, and step 233 is equivalent of step 227. Step 234 will cause a loop back through steps 229–234 if more basic characters are to be added, e.g., as indicated by more data in rows 44, 46, and 48. Compound characters are then output to the printer through output buffer 22 at step 228 after the last basic character has been transformed and placed.

In the system described above, the complete border data for any particular character is obviously not being stored directly. Only the coordinate data relating to the starting, intermediate, and ending points of an imaginary base line and the respective border data local to each point are being stored. The complete border data and bit pattern to fill it can and are computed in the above system. The savings in memory needed to store a whole Kanji character set is significant. In the above system, the quality of a character is determined by the local border data that describes the beginning, ending, and any bends of a brush stroke. A superior pattern can be obtained at the same time the memory capacity is reduced, all without reducing the quality of a character.

Figure 11:
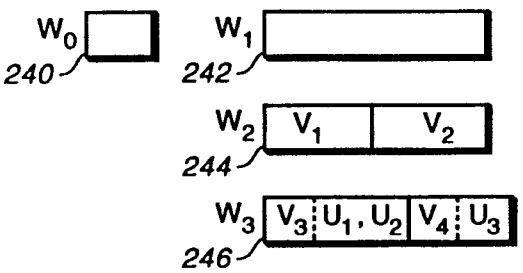
FIG. 11 is a diagram of a data structure similar to that of FIGS. 4 and 5.

Referring to the data structure of FIG. 11, and as mentioned above, it is possible for compound characters to be made up themselves of a combination of two or more compound characters. Or characters can be made up of a mixture of both basic and compound characters. For example, the compound character of FIG. 1(*j*) is made up of the basic character of FIG. 1(*h*) and the compound character of FIG. 1(*i*). The character of FIG. 1(*i*) is compound because it consists of the characters of FIG. 1(*k*) (meaning "eye") and FIG. 1(*l*) (meaning "eight"). As an example of the use of the data structure of FIG. 11, a header 240 holds an index code (W0) for the character of FIG. 1(*j*). A row 242 (W1) contains a data structure similar to row 42 in FIG. 4. A pointer in the basic field 50 points to a basic character in character memory 18 representing the basic character of FIG. 1(*h*). Row 242 also holds the position field 52 and magnification field 58 data that is used to compress the basic character of FIG. 1(*h*) into its position at the top of the compound character of FIG. 1(*j*). The character of FIG. 1(*i*), while a component of the compound character of FIG. 1(*j*), is itself a compound character, as indicated by $V_1$ and $V_2$ in a row 244. Row 244 therefore has two sets of pointers, position, and magnification data for each of the two basic characters that comprise the character of FIG. 1(*i*). $V_1$ and $V_2$ are each similar to $W_1$. For the present example a third row 246 ($W_3$) is not used. The net effect of the data structure of FIG. 11 is to provide all the data necessary to compute a properly formed character of FIG. 1(*j*), even after nesting to two levels to get all the basic elements.

Figure 12:
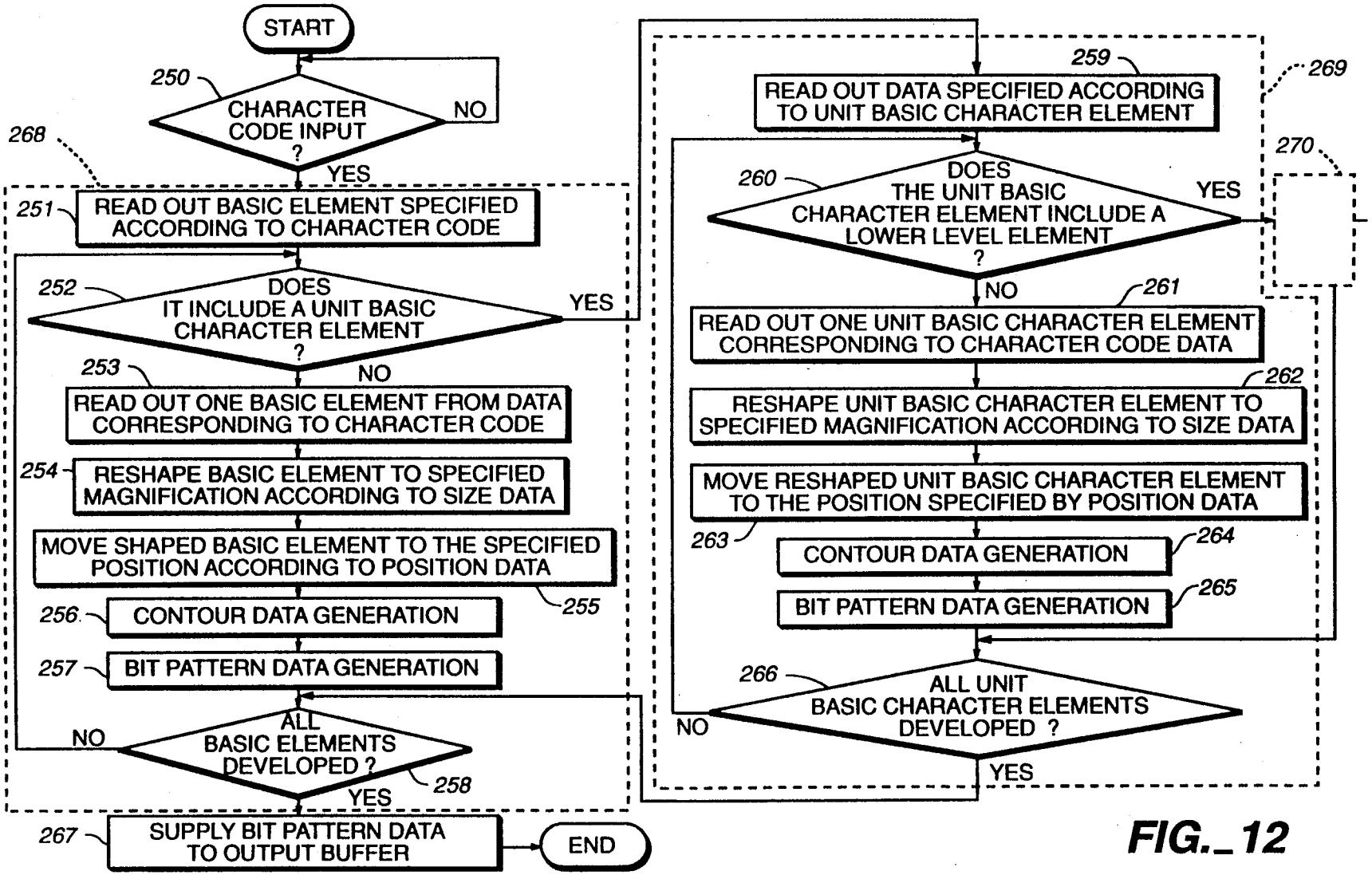
FIG. 12 is a flowchart for a second computer-implemented process that runs on the system of FIG. 2.

Referring now to the flowchart of FIG. 12, microcontroller 24 executes a computer-implemented process comprised of a number of steps 250–267. The process loops at step 250 waiting for a character code to be input. When a character code is input, e.g., from an external device such as keyboard 14 or host-computer 12, in step 251, microcontroller 24 reads out from character memory 18 the data corresponding to the code input, and places it in data memory 20. Step 252 tests the character to see if it is defined to include a more basic element, called a unit basic character element. If not, the process proceeds to step 253 to read out one (or the next) element from the data corresponding to the input character code. (Step 252 will allow a nested character, such as given as an example above as being in $W_2$, to be broken down into its two basic characters.) Step 254 reshapes the element to the specifications found in the magnification field 58. The reshaped element is then moved into the position specified by data in the position field 52 at step 255. A complete border is then contoured around the reshaped element, in step 256. The completed border is filled in step 257 with a bit pattern. Step 258 will cause the process to loop back to repeat steps 252–258 if there are more elements that still need to be rendered to complete the character. If at step 252 a basic character element is detected, then a branch is made to step 259. Step 259 causes data to be read out according to the basic character element. A test at step 260 looks to see if the basic character element includes a yet more basic level element. If not, control passes to step 261 where one basic character is read out according to the character code input. Step 262 reshapes the element to the specifications found in the magnification field 58. The reshaped element is then moved into the position specified by data in the position field 52 at step 263. A complete border is then contoured around the reshaped element, in step 264. The completed border is filled in step 265 with a bit pattern. Step 266 will cause the process to loop back to repeat steps 260–266 if there are more elements that still need to be rendered to complete the character. Otherwise, control is passed back to step 258 to see if more characters need to be added. If not, step 267 outputs the bit pattern held in data memory 20 to output buffer 22. A sub-process 268 is formed by grouping steps 251–258. And grouping steps 259–266 forms a sub-process 269. If a basic character element having a yet more basic element was detected at step 260, then a branch is made to a sub-process 270. Sub-process 269 returns control to sub-process 268 after step 266. Sub-process 270 is functionally the same as sub-processes 268 and 269.

Figure 13:
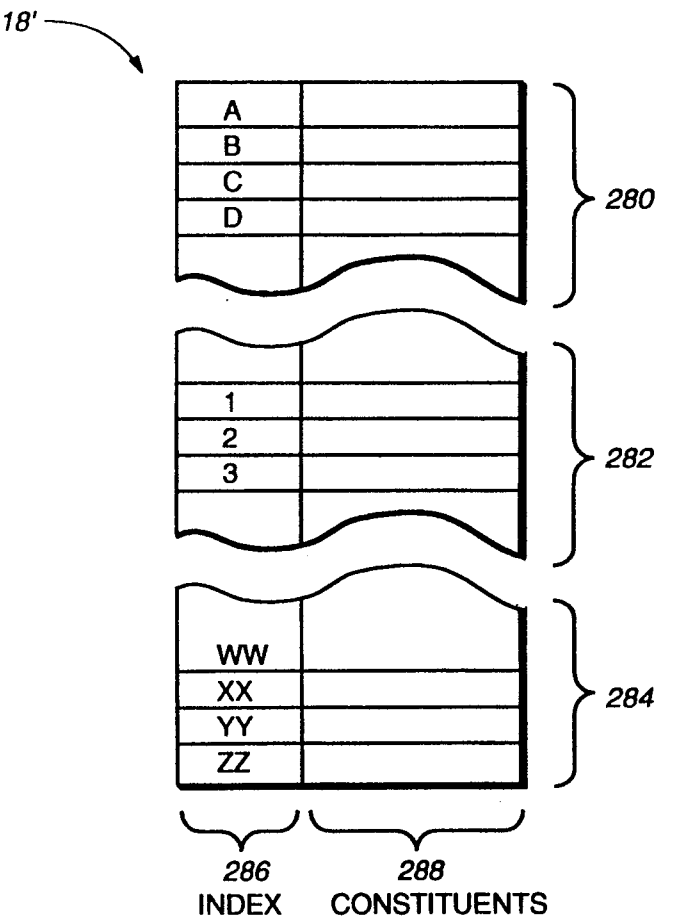
FIG. 13 is an alternative embodiment of the top level data structure used to store character data in the data memory of the system in FIG. 2. It is divided into basic character, local border data, and compound character storage areas.

In an alternate embodiment, the hardware of system of FIG. 2 is again used, but the character memory 18 has a structure that differs from that shown in FIG. 3. The difference is signalled by making element 18 prime (18'). FIG. 13 is a data structure placed in character memory 18'. It is roughly divided into a first region 280 for storing basic character codes, a second region 282 for storing end contour codes, and a third region 284 for storing compound character codes. Region 280 stores the starting point coordinate $X_s$, $Y_s$, intermediate point coordinate Xm, Ym, and the ending point coordinate $X_e$, $Y_e$ for specifying the base line, and local border code together with the basic component code for specifying local borders associated with $X_s$, $Y_s$; $X_m$, $Y_m$; and $X_e$, $Y_e$. The storage is the same as was described above. The second region 282 is used to store the local border data which is specified by the local border code in the first region 280. The third region 284 is used to store composing information in which a compound character is created by combining basic components belonging to the first region 284.

Figure 14:
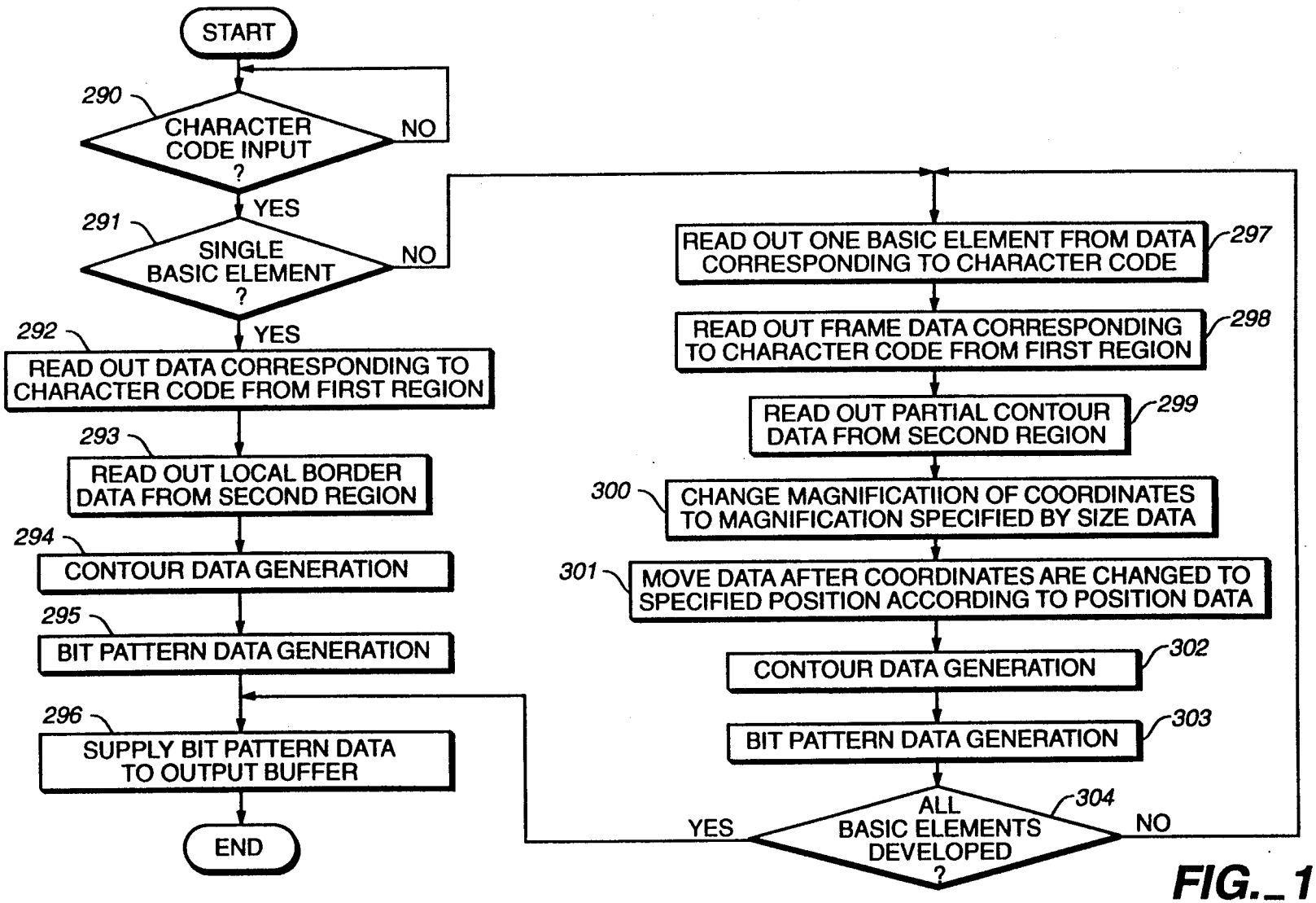
FIG. 14 is a flowchart for an alternative embodiment of a computer-implemented process that runs on the system of FIG. 2.

Referring now to the exemplary flowchart of FIG. 14, microcontroller 24 executes a computer-implemented process comprised of a number of steps 290–304. The process loops at step 290 waiting for a character code to be input (as above). When the character code is input from the external device, microcontroller 24 recognizes at step 291 whether it is a basic character code or a compound character code. If it is a basic character code, access is made in step 292 to the first region 280 of character memory 18'. The starting point coordinate $X_s$, $Y_s$, intermediate point coordinate $X_m$, $Y_m$, and any ending point coordinate $X_e$, $Y_e$, are all read out. In step 293 the local border data is fetched from the second region 282 (using a local border code stored in the first region 280 as an index or key). In step 294, microcontroller 24 generates and contours complete border data for the character using only the above coordinate and local border data. The completed border is then filled in by step 295 with bit pattern data, and stored in data memory 20. Step 296 then outputs the bit pattern data to output buffer 22. When the external character code input is determined to be a compound character in step 291, control will branch to step 297. There, microcontroller 24 accesses the third region 284 of character memory 18', and reads out a basic component code. The basic component code is used to access the first region 280. What is returned is the (imaginary baseline's) starting point coordinate $X_s$, $Y_s$, ending point coordinate $X_e$, $Y_e$ and any intermediate point coordinate $X_m$, $Y_m$. Step 298 reads out frame data corresponding to a character from the first region 280. Step 299 causes local border data to be read out from the second region 282. At step 300, coordinate data is transformed by the magnification specified by the data in field 58 (FIG. 4). Step 301 moves data to its new position. In step 302, microcontroller 24 generates and contours complete border data for the basic character using only the above coordinate and local border data. The completed border is then filled in by step 303 with bit pattern data, and stored in data memory 20. If all the basic elements have not been developed, control loops back to step 297 from step 304 Otherwise, step 296 outputs the data for printing.

Figure 15:
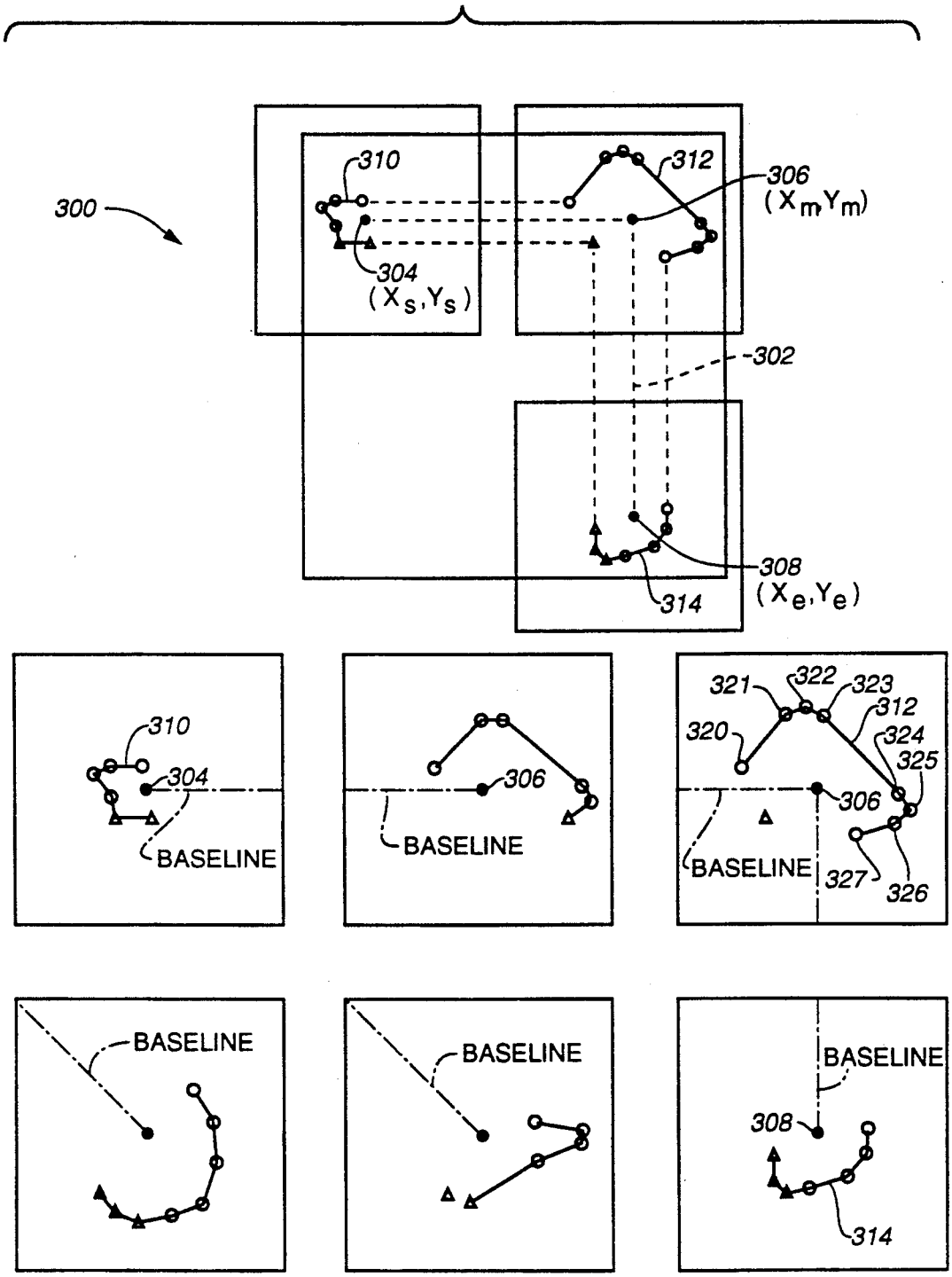
FIG. 15 is a drawing of an exemplary Kanji basic character and its local border data.

FIG. 15 is a Kanji character, and is referred to by the general reference numeral 300. Character 300 has a baseline 302 with a baseline starting point 304 (coordinate $X_s$, $Y_s$), a middle point 306 (coordinate $X_m$, $Y_m$), and an ending point 308 (coordinate $X_e$, $Y_e$). A local border 310 is associated with point 304, a local border 312 is associated with point 306, and a third local border 314 is associated with point 308. Local borders associated with the starting, ending, and the intermediate point coordinates can be of four types. Type one which is open to its right side, a second type which is open to its left side, a third type which is open to its down side, and a fourth type which is open to its up side. The local border data of local border data 312 is shown to consist of a plurality of points 320–327. FIG. 15 has six variations of border data.

Figure 16A:
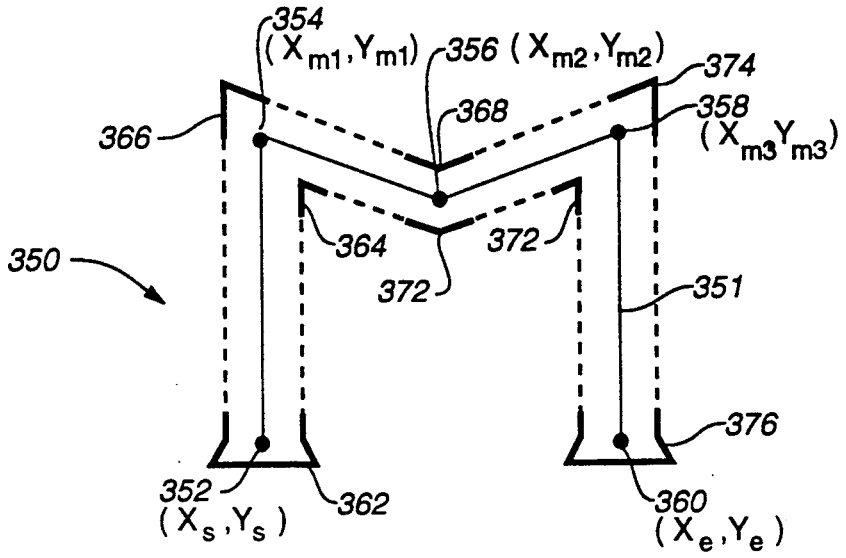
FIGS. 16A and 16B are drawings of an exemplary alphabetic basic character for the letter "M" having one baseline with three middle coordinates and eight local border data sets.
Figure 16B:
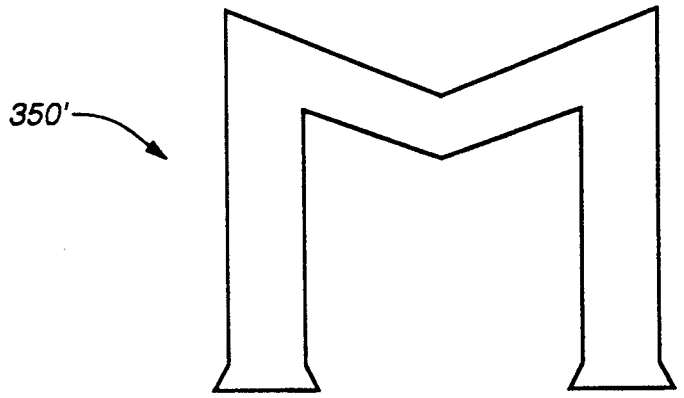

Although the emphasis above has been on Chinese and Japanese characters, the alphabet can just as easily be implemented and benefit from the present invention. For example, in FIGS. 16A and (*b*) a letter "M" 350, has a single baseline 351 starting point coordinate 360 ($x_e$, $y_e$). Eight sets of local border data: 362, 364, 366, 368, 370, 372, 374, and 376 are associated respectively with coordinates 352, 354, 356, 358, and 360. Storage, generation, and output of letter 350 are the same as described above for the Kanji characters.

While the invention has been described in conjunction with a few specific embodiments, it will be evident to those skilled in the art that many other alternatives, modifications and variations are possible in light of the foregoing description. Thus, the invention described herein is intended to embrace all such alternatives, modifications, applications and variations as fall within the true spirit and scope of the following claims.

What is claimed is:

1. A character generating system, comprising:

memory means including first and second regions each region having a plurality of sections, each section of said first region including:

a first part for storing a basic character code associated with a corresponding basic element, and a second part for storing basic element data associated with the corresponding basic element, the basic element data including a plurality of stroke data sets, each stroke data set associated with a corresponding stroke of the corresponding basic element and including coordinate data and associated local border data relative to a local reference point, the coordinate data including coordinates for a starting point, one or more middle points for a bending stroke, and an ending point of a baseline that substantially runs through the centerline of the corresponding stroke, each middle point corresponding to a point at a bending portion of the baseline between the starting and ending points, the local border data including a plurality of groups of coordinates for a plurality of groups of points, each group of points surrounding one of the starting, middle, and ending points of the baseline and forming a portion of the contour of the corresponding stroke;

each section of said second region including:

a first part for storing a compound character code associated with a corresponding compound character, and a second part for storing compound character data associated with the corresponding compound character, the compound character data including a plurality of constituent data sets, each constituent data set associated with the corresponding constituent basic element of the corresponding compound character and including a basic element pointer for referencing to basic element data associated with the corresponding constituent basic element in said first region, magnification data for adjusting the size of the corresponding constituent basic element and position data for specifying the position of the corresponding constituent basic element in the compound character;

means for receiving an externally input character code associated with a particular character;

means, responsive to said receiving means, for determining whether the input character code is a basic character code;

means, responsive to said determining means, for retrieving basic element data corresponding to the input character code from said first region if the input character code is a basic character code and, if the input character code is not a basic character code, for retrieving compound character data corresponding to the input character code from said second region for retrieving basic element data associated with constituent basic elements of the particular character from said first region using associated basic element pointers in the retrieved compound character data;

means, responsive to said retrieving means, for adjusting the retrieved basic element data using associated magnification data in the retrieved compound character data for reshaping the constituent basic elements if the input character code is not a basic character code;

means, responsive to said adjusting means, for modifying the adjusted basic element data using associated position data in the retrieved compound character data for positioning the constituent basic elements in the particular character;

means, responsive to said retrieving means and said modifying means, for generating contour data based on the retrieved basic element data for forming a contour of the particular character if the input character code is a basic character code and, if the input character code is not a basic character code, for generating contour data based on the modified adjusted basic element data for forming a contour of the particular character; and means, responsive to said contour data generating means, for generating bit data for filling in the contour of the particular character specified by the generated contour data.

2. The system of claim 1 wherein said adjusting means adjusts the retrieved basic element data by multiplying the coordinate data and the associated local border data in the retrieved basic element data by the associated magnification data in the retrieved compound character data.

3. The system of claim 1 wherein said modifying means modifies the adjusted basic element data by changing the coordinate data and the associated local border data in the retrieved basic element data with respect to new local reference points specified by the associated position data in the retrieved compound character data.

4. The system of claim 1 wherein said contour data generating means generates the contour data in the form of a plurality of coordinates positioned between two adjacent groups of points in the local border data in the retrieved basic element data for forming the contour of the particular character.

5. The system of claim 1, further comprising output means for constructing the particular character using the generated contour data and the generated bit data.

6. A character generating system, comprising:

memory means including first and second regions each region having a plurality of sections, each section of said first region including:

a first part for storing a unit code associated with a corresponding unit basic element, and a second part for storing unit basic element data associated with the corresponding unit basic element, the unit basic element data including a plurality of stroke data sets, each stroke data set associated with a corresponding stroke of the corresponding unit basic element and including coordinate data and associated local border data relative to a local reference point, the coordinate data including coordinates for a starting point, one or more middle points for a bending stroke, and an ending point of a baseline that substantially runs through the centerline of the corresponding stroke, each middle point corresponding to a point at a bending portion of the baseline between the starting and ending points, the local border data including a plurality of groups of coordinates for a plurality of groups of points, each group of points surrounding one of the starting, middle, and ending points of the baseline and forming a portion of the contour of the corresponding stroke;

each section of said second region including:

a first part for storing a character code associated with a corresponding character, and a second part for storing character data associated with the corresponding character, the character data including a plurality of constituent data sets, each constituent data set associated with a corresponding basic element of the corresponding character and including at least one basic set of data which comprises a pointer for referencing to unit basic element data associated with a corresponding unit basic element in said first region, magnification data for adjusting the size of the corresponding unit basic element and position data for specifying the position of the corresponding unit basic element in the corresponding character;

means for receiving an externally input character code associated with a particular character;

means, responsive to said receiving means, for retrieving constituent data sets corresponding to the input character code from said second region;

means, responsive to said receiving means, for detecting whether each of the retrieved constituent data sets includes more than one basic set of data;

means, responsive to said detecting means, for retrieving associated unit basic element data from said first region using associated pointer in a basic set of data in a particular constituent data set retrieved if the particular constituent data set includes only one basic set of data and, if the particular constituent data set includes more than one basic set of data, for retrieving unit basic element data associated with all basic sets of data in the particular constituent data set from said first region using associated pointers in the particular constituent data set;

means, responsive to said unit basic element data retrieving means, for adjusting the retrieved unit basic element data using associated magnification data in the retrieved constituent data sets for reshaping corresponding unit basic elements;

means, responsive to said adjusting means, for modifying the adjusted unit basic element data using associated position data in the retrieved constituent data sets for positioning the corresponding unit basic elements in the particular character;

means, responsive to said modifying means, for generating contour data based on the modified adjusted unit basic element data for forming a contour of the particular character; and means, responsive to said contour data generating means, for generating bit data for filling in the contour of the particular character specified by the generated contour data.

7. The system of claim 6 wherein said adjusting means adjusts the retrieved unit basic element data by multiplying the coordinate data and the associated local border data in the retrieved unit basic element data by the associated magnification data in the retrieved constituent data sets.

8. The system of claim 6 wherein said modifying means modifies the adjusted unit basic element data by changing the coordinate data and the associated local border data in the retrieved unit basic element data with respect to new local reference points specified by the associated position data in the retrieved constituent data sets.

9. The system of claim 6 wherein said contour data generating means generates the contour data in the form of a plurality of coordinates positioned between two adjacent groups of points in the local border data in the retrieved unit basic element data for forming the contour of the particular character.

10. The system of claim 6, further comprising output means for constructing the particular character using the generated contour data and the generated bit data.

11. A character generating system, comprising:

memory means including first, second and third regions each region having a plurality of sections, each section of said first region including:

a first part for storing a basic character code associated with a corresponding basic element, and a second part for storing basic element data associated with the corresponding basic element, the basic element data including a plurality of stroke data sets, each stroke data set associated with a corresponding stroke of the corresponding basic element and including coordinate data and associated local border code, the coordinate data including coordinates for a starting point, one or more middle points for a bending stroke, and an ending point of a baseline that substantially runs through the centerline of the corresponding stroke, each middle point corresponding to a point at a bending portion of the baseline between the starting and ending points, the local border code for referencing to corresponding local border data;

each section of said second region including:

a first part for storing a local border code associated with corresponding local border data, and a second part for storing the corresponding local border data including a plurality of groups of coordinates for a plurality of groups of points, each group of points surrounding one of the starting, middle, and ending points of the baseline of a corresponding stroke and forming a portion of the contour of the corresponding stroke;

each section of said third region including:

a first part for storing a compound character code associated with a corresponding compound character, and a second part for storing compound character data associated with the corresponding compound character, the compound character data including a plurality of constituent data sets, each constituent data set associated with a corresponding constituent basic element of the corresponding compound character and including a basic element pointer for referencing to basic element data associated with the corresponding constituent basic element in said first region, magnification data for adjusting the size of the corresponding constituent basic element and position data for specifying the position of the corresponding constituent basic element in the compound character;

means for receiving an externally input character code associated with a particular character;

means, responsive to said receiving means, for determining whether the input character code is a basic character code;

means, responsive to said determining means, for retrieving basic element data corresponding to the input character code from said first region if the input character code is a basic character code and, if the input character code is not a basic character code, for retrieving compound character data corresponding to the input character code from said third region for retrieving basic element data associated with constituent basic elements of the particular character from said first region using associated basic element pointers in the retrieved compound character data;

means, responsive to said basic element data retrieving means, for retrieving corresponding local border data from said second region using associated local border codes in the retrieved basic element data;

means, responsive to said local border data retrieving means, for adjusting the coordinate data in the retrieved basic element data and the retrieved associated local border data using associated magnification data in the retrieved compound character data for reshaping the constituent basic elements if the input character code is not a basic character code;

means, responsive to said adjusting means, for modifying the adjusted coordinate data and associated local border data using associated position data in the retrieved compound character data for positioning the constituent basic elements in the particular character;

means, responsive to said local border data retrieving means and said modifying means, for generating contour data based on the coordinate data in the retrieved basic element data and the retrieved associated local border data for forming a contour of the particular character if the input character code is a basic character code and, if the input character code is not a basic character code, for generating contour data based on the modified adjusted coordinate data and associated local border data for forming a contour of the particular character; and means, responsive to said contour data generating means, for generating bit data for filling in the contour of the particular character specified by the generated contour data.

12. The system of claim 11 wherein said adjusting means adjusts the coordinate data and associated local border data by multiplying the coordinate data and the associated local border data by the associated magnification data in the retrieved compound character data.

13. The system of claim 11 wherein said modifying means modifies the adjusted coordinate data and associated local border data by changing the coordinate data and the associated local border data with respect to new local reference points specified by the associated position data in the retrieved compound character data.

14. The system of claim 11 wherein said contour data generating means generates the contour data in the form of a plurality of coordinates positioned between two adjacent groups of points in the retrieved associated local border data for forming the contour of the particular character.

15. The system of claim 11, further comprising output means for constructing the particular character using the generated contour data and the generated bit data.

16. A character generating method, comprising:

prestoring a basic character code and basic element data associated with a corresponding basic element in each section of a first region in memory means, the basic element data including a plurality of stroke data sets, each stroke data set associated with a corresponding stroke of the corresponding basic element and including coordinate data and associated local border data relative to a local reference point, the coordinate data including coordinates for a starting point, one or more middle points for a bending stroke, and an ending point of a baseline that substantially runs through the centerline of the corresponding stroke, each middle point corresponding to a point at a bending portion of the baseline between the starting and ending points, the local border data including a plurality of groups of coordinates for a plurality of groups of points, each group of points surrounding one of the starting, middle, and ending points of the baseline and forming a portion of the contour of the corresponding stroke;

prestoring a compound character code and compound character data associated with a corresponding compound character in each section of a second region in the memory means, the compound character data including a plurality of constituent data sets, each constituent data set associated with a corresponding constituent basic element of the corresponding compound character and including a basic element pointer for referencing to basic element data associated with the corresponding constituent basic element in the first region, magnification data for adjusting the size of the corresponding constituent basic element and position data for specifying the position of the corresponding constituent basic element in the compound character;

receiving an externally input character code associated with a particular character;

determining whether the input character code is a basic character code;

retrieving basic element data corresponding to the input character code from the first region if the input character code is a basic character code;

if the input character code is not a basic character code, retrieving compound character data corresponding to the input character code from the second region for retrieving basic element data associated with constituent basic elements of the particular character from the first region using associated basic element pointers in the retrieved compound character data;

adjusting the retrieved basic element data using associated magnification data in the retrieved compound character data for reshaping the constituent basic elements if the input character code is not a basic character code;

modifying the adjusted basic element data using associated position data in the retrieved compound character data for positioning the constituent basic elements in the particular character;

generating contour data based on the retrieved basic element data for forming a contour of the particular character if the input character code is a basic character code;

if the input character code is not a basic character code, generating contour data based on the modified adjusted basic element data for forming a contour of the particular character; and generating bit data for filling in the contour of the particular character specified by the generated contour data.

17. The method of claim 16 wherein said step of adjusting the retrieved basic element data includes multiplying the coordinate data and the associated local border data in the retrieved basic element data by the associated magnification data in the retrieved compound character data.

18. The method of claim 16 wherein said step of modifying the adjusted basic element data includes changing the coordinate data and the associated local border data in the retrieved basic element data with respect to new local reference points specified by the associated position data in the retrieved compound character data.

19. The method of claim 16 wherein said step of generating contour data includes generating the contour data in the form of a plurality of coordinates positioned between two adjacent groups of points in the local border data in the retrieved basic element data for forming the contour of the particular character.

20. The method of claim 16, further comprising constructing the particular character using the generated contour data and the generated bit data.

21. A character generating method, comprising:

prestoring a unit code and unit basic element data associated with a corresponding unit basic element in each section of a first region in memory means, the unit basic element data including a plurality of stroke data sets, each stroke data set associated with a corresponding stroke of the corresponding unit basic element and including coordinate data and associated local border data relative to a local reference point, the coordinate data including coordinates for a starting point, one or more middle points for a bending stroke, and an ending point of a baseline that substantially runs through the centerline of the corresponding stroke, each middle point corresponding to a point at a bending portion of the baseline between the starting and ending points, the local border data including a plurality of groups of coordinates for a plurality of groups of points, each group of points surrounding one of the starting, middle, and ending points of the baseline and forming a portion of the contour of the corresponding stroke;

prestoring a character code and character data associated with a corresponding character in each section of a second region in the memory means, the character data including a plurality of constituent data sets, each constituent data set associated with a corresponding basic element of the corresponding character and including at least one basic set of data which comprises a pointer for referencing to unit basic element data associated with a corresponding unit basic element in the first region, magnification data for adjusting the size of the corresponding unit basic element and position data for specifying the position of the corresponding unit basic element in the corresponding character;

receiving an externally input character code associated with a particular character;

retrieving constituent data sets corresponding to the input character code from the second region;

detecting whether each of the retrieved constituent data sets includes more than one basic set of data;

retrieving associated unit basic element data from the first region using associated pointer in a basic set of data in a particular constituent data set retrieved if the particular constituent data set includes only one basic set of data;

if the particular constituent data set includes more than one basic set of data, retrieving unit basic element data associated with all basic sets of data in the particular constituent data set from the first region using associated pointers in the particular constituent data set;

adjusting the retrieved unit basic element data using associated magnification data in the retrieved constituent data sets for reshaping corresponding unit basic elements;

modifying the adjusted unit basic element data using associated position data in the retrieved constituent data sets for positioning the corresponding unit basic elements in the particular character;

generating contour data based on the modified adjusted unit basic element data for forming a contour of the particular character; and generating bit data for filling in the contour of the particular character specified by the generated contour data.

22. The method of claim 21 wherein said step of adjusting the retrieved unit basic element data includes multiplying the coordinate data and the associated local border data in the retrieved unit basic element data by the associated magnification data in the retrieved constituent data sets.

23. The method of claim 21 wherein said step of modifying the adjusted unit basic element data includes changing the coordinate data and the associated local border data in the retrieved unit basic element data with respect to new local reference points specified by the associated position data in the retrieved constituent data sets.

24. The method of claim 21 wherein said step of generating contour data includes generating the contour data in the form of a plurality of coordinates positioned between two adjacent groups of points in the local border data in the retrieved unit basic element data for forming the contour of the particular character.

25. The method of claim 21, further comprising constructing the particular character using the generated contour data and the generated bit data.

26. A character generating method, comprising:

prestoring a basic character code and basic element data associated with a corresponding basic element in each section of a first region in memory means, the basic element data including a plurality of stroke data sets, each stroke data set associated with a corresponding stroke of the corresponding basic element and including coordinate data and associated local border code, the coordinate data including coordinates for a starting point, one or more middle points for a bending stroke, and an ending point of a baseline that substantially runs through the centerline of the corresponding stroke, each middle point corresponding to a point at a bending portion of the baseline between the starting and ending points, the local border code for referencing to corresponding local border data;

prestoring a local border code and associated local border data in each section of a second region in the memory means, the associated local border data including a plurality of groups of coordinates for a plurality of groups of points, each group of points surrounding one of the starting, middle, and ending points of the baseline of a corresponding stroke and forming a portion of the contour of the corresponding stroke;

prestoring a compound character code and compound character data associated with a corresponding compound character in each section of a third region in the memory means, the compound character data including a plurality of constituent data sets, each constituent data set associated with a corresponding constituent basic element of the corresponding compound character and including a basic element pointer for referencing to basic element data associated with the corresponding constituent basic element in the first region, magnification data for adjusting the size of the corresponding constituent basic element and position data for specifying the position of the corresponding constituent basic element in the compound character;

receiving an externally input character code associated with a particular character;

determining whether the input character code is a basic character code;

retrieving basic element data corresponding to the input character code from the first region if the input character code is a basic character code;

if the input character code is not a basic character code, retrieving compound character data corresponding to the input character code from the third region for retrieving basic element data associated with constituent basic elements of the particular character from the first region using associated basic element pointers in the retrieved compound character data;

retrieving corresponding local border data from the second region using associated local border codes in the retrieved basic element data;

adjusting the coordinate data in the retrieved basic element data and the retrieved associated local border data using associated magnification data in the retrieved compound character data for reshaping the constituent basic elements if the input character code is not a basic character code;

modifying the adjusted coordinate data and associated local border data using associated position data in the retrieved compound character data for positioning the constituent basic elements in the particular character;

generating contour data based on the coordinate data in the retrieved basic element data and the retrieved associated local border data for forming a contour of the particular character if the input character code is a basic character code;

if the input character code is not a basic character code, generating contour data based on the modified adjusted coordinate data and associated local border data for forming a contour of the particular character; and generating bit data for filling in the contour of the particular character specified by the generated contour data.

27. The method of claim 26 wherein said step of adjusting the coordinate data and associated local border data includes multiplying the coordinate data and the associated local border data by the associated magnification data in the retrieved compound character data.

28. The method of claim 26 wherein said step of modifying the adjusted coordinate data and associated local border data includes changing the coordinate data and the associated local border data with respect to new local reference points specified by the associated position data in the retrieved compound character data.

29. The method of claim 26 wherein said step of generating contour data includes generating the contour data in the form of a plurality of coordinates positioned between two adjacent groups of points in the retrieved associated local border data for forming the contour of the particular character.

30. The method of claim 26, further comprising constructing the particular character using the generated contour data and the generated bit data.

* * * * *